US010048620B1

(12) United States Patent
Hatano

(10) Patent No.: US 10,048,620 B1
(45) Date of Patent: Aug. 14, 2018

(54) DEVELOPING DEVICE AND IMAGE FORMING APPARATUS THEREWITH

(71) Applicant: KYOCERA Document Solutions Inc., Osaka (JP)

(72) Inventor: Masaru Hatano, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/877,053

(22) Filed: Jan. 22, 2018

(30) Foreign Application Priority Data

Feb. 15, 2017 (JP) ..... 2017-025809

(51) Int. Cl.

| | |
|---|---|
| ***G03G 15/08*** | (2006.01) |
| ***G03G 15/09*** | (2006.01) |
| ***G03G 9/107*** | (2006.01) |
| ***G03G 21/10*** | (2006.01) |
| ***G03G 9/087*** | (2006.01) |

(52) U.S. Cl.
CPC ..... *G03G 15/0872* (2013.01); *G03G 9/08755* (2013.01); *G03G 9/107* (2013.01); *G03G 15/0808* (2013.01); *G03G 15/0824* (2013.01); *G03G 15/0881* (2013.01); *G03G 21/105* (2013.01)

(58) Field of Classification Search
CPC ..... G03G 15/0808; G03G 15/0812; G03G 15/0815; G03G 15/0921; G03G 15/0935
USPC ..... 399/273, 274
See application file for complete search history.

(56) References Cited

U.S. PATENT DOCUMENTS

| | | | | |
|---|---|---|---|---|
| 9,335,661 | B2 * | 5/2016 | Kusukawa ..... | G03G 15/0808 |
| 2013/0209142 | A1 | 8/2013 | Kusukawa et al. ..... | 399/274 |
| 2014/0140740 | A1 | 5/2014 | Yamane et al. ..... | 399/274 |

FOREIGN PATENT DOCUMENTS

| | | |
|---|---|---|
| JP | 2013-190767 A | 9/2013 |
| JP | 2014-102339 A | 6/2014 |

* cited by examiner

*Primary Examiner* — William J Royer
(74) *Attorney, Agent, or Firm* — Stein IP, LLC

(57) ABSTRACT

A developing device has a developing roller, a toner feeding roller, a regulating blade, a casing, a film member, a biasing member, and first and second gears. The casing has an inner wall part facing the developing roller between the regulating blade and an image carrying member. The film member is flexible, and can vibrate in a direction approaching or away from the inner wall part. The biasing member applies a tension to the film member in its longitudinal direction. The first and second gears are coupled to a gear train driving the developing roller or the toner feeding roller, and have formed on their circumferential surfaces first and second protrusions vibrating the film member by intermittently making contact with one edge and the other edge of the film member respectively.

8 Claims, 9 Drawing Sheets

DEVELOPING DEVICE AND IMAGE FORMING APPARATUS THEREWITH

INCORPORATION BY REFERENCE

This application is based upon and claims the benefit of priority from the corresponding Japanese Patent Application No. 2017-025809 filed on Feb. 15, 2017, the entire contents of which are incorporated herein by reference.

BACKGROUND

The present disclosure relates to a developing device that feeds developer to an image carrying member, and to an electrophotographic image forming apparatus provided with such a developing device.

In image forming apparatuses utilizing electrophotography, an electrostatic latent image is formed by irradiating the circumferential surface of an image carrying member (photosensitive drum) with light based on image data read from a document image or image data transmitted from an external device such as a computer. To this electrostatic latent image, toner is fed from a developing device to form a toner image, and then the toner image is transferred to a sheet. After the transfer, the sheet undergoes toner image fixing, and is then discharged to the outside.

As a developing system that uses dry toner adopted in image forming apparatuses adopting an electro-photographic process, a two-component developing system as will be described below that uses a magnetic roller (toner feeding roller) and a developing roller has been proposed. First, two-component developer is carried on a magnetic roller and then, while magnetic carrier is left on the magnetic roller, only non-magnetic toner is transferred to a developing roller to form a thin layer of toner thereon. Then, in a region (developing region) where the developing roller and a photosensitive member (image carrying member) face each other, by the action of an AC electric field, toner on the developing roller is made to fly to attach to an electrostatic latent image on the photosensitive member.

On the other hand, the recent ever-increasing speed of image formation in image forming apparatuses necessitates high-speed rotation of a toner stirring member in a developing device. In particular, with the above-mentioned developing system which uses two-component developer containing magnetic carrier and toner and which uses a magnetic roller carrying thereon developer and a developing roller carrying thereon toner alone, in the part where the developing roller and the magnetic roller face each other, toner alone flies from the magnetic roller to the developing roller, and in addition toner left unused during development flies from the developing roller to the magnetic roller. Thus, toner is likely to be suspended near the part where the developing roller and the magnetic roller face each other, and the suspended toner accumulates around a trimming blade (regulating blade). If the accumulated toner agglomerates and attaches to the developing roller, toner droppings may inconveniently result, leading to image defects.

As a solution to the inconvenience discussed above, a developing device is known which has an inner wall part facing a developing roller between a regulating blade and a developing region and which includes a film member that is arranged with a predetermined distance from a top surface of the inner wall part and that can vibrate in a direction approaching or away from the inner wall part, a biasing member which applies a tension to the film member, and an idle gear which constitutes a gear train driving the developing roller or the magnetic roller and which has formed thereon a protrusion that vibrates the film member by intermittently making contact with an edge of the film member as a gear rotates, wherein the film member is vibrated by the rotation of the idle gear to shake off the toner accumulated on the top surface of the inner wall part.

SUMMARY

According to one aspect of the present disclosure, a developing device includes a developing roller, a toner feeding roller, a regulating blade, a casing, a film member, a biasing member, a first gear, and a second gear. The developing roller is arranged opposite an image carrying member on which an electrostatic latent image is formed, and feeds toner to the image carrying member in a region where the developing roller and the image carrying member face each other. The toner feeding roller is arranged opposite the developing roller, and feeds toner to the developing roller in a region where the toner feeding roller and the developing roller face each other. The regulating blade is arranged opposite the toner feeding roller across a predetermined gap. The casing houses in it the developing roller, the toner feeding roller, and the regulating blade, and has an inner wall part that faces the developing roller between the regulating blade and the image carrying member. The film member is flexible, is arranged with a predetermined distance from a top surface of the inner wall part, and is able to vibrate in a direction approaching or away from the inner wall part. The biasing member is coupled to at least one end of the film member in its longitudinal direction, and applies a tension to the film member. The first gear is coupled to a gear train that drives the developing roller or the toner feeding roller, and has formed on its circumferential surface at least one first protrusion which vibrates the film member by intermittently making contact with one edge of the film member. The second gear is coupled to a gear train that drives the developing roller or the toner feeding roller, and has formed on its circumferential surface at least one second protrusion which vibrates the film member by intermittently making contact with the other edge of the film member.

Further features and advantages of the present disclosure will become apparent from the description of embodiments given below.

DETAILED DESCRIPTION

Figure 1:
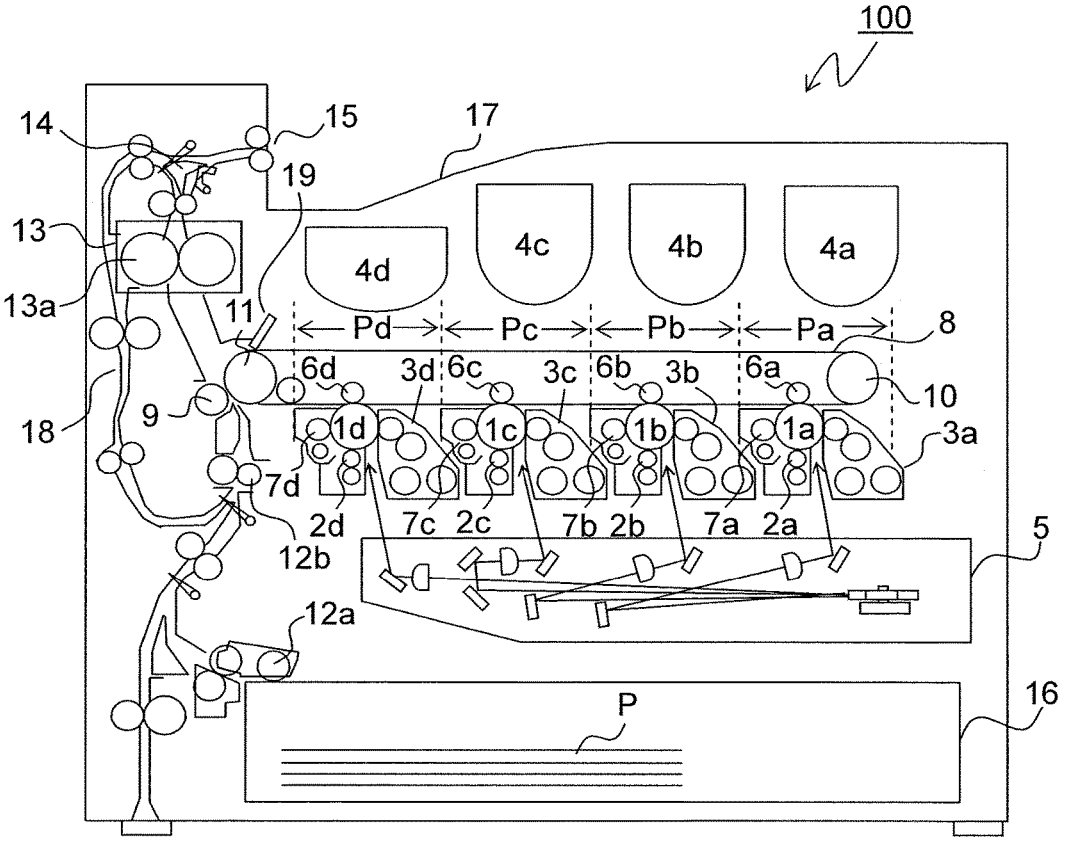
FIG. 1 is a diagram showing an outline of a construction of a color printer incorporating a developing device according to the present disclosure.

Hereinafter, embodiments of the present disclosure will be described with reference to the accompanying drawings. FIG. 1 is a schematic sectional view of an image forming apparatus incorporating developing devices 3*a* to 3*d* according to the present disclosure, here showing a tandem-type color printer 100. Inside the main body of the color printer 100, four image forming portions Pa, Pb, Pc, and Pd are arranged in this order from the upstream side in the conveyance direction (the right side in FIG. 1). These image forming portions Pa to Pd are provided to correspond to images of four different colors (cyan, magenta, yellow, and black) respectively, and sequentially form cyan, magenta, yellow, and black images respectively, each through the processes of electrostatic charging, exposure to light, image development, and image transfer.

In these image forming portions Pa to Pd, there are respectively arranged photosensitive drums 1*a*, 1*b*, 1*c* and 1*d* that carry visible images (toner images) of the different colors. Moreover, an intermediate transfer belt 8 that rotates in the clockwise direction in FIG. 1 is arranged next to the image forming portions Pa to Pd.

When image data is fed in from a host device such as a personal computer, first, by charging devices 2*a* to 2*d*, the surfaces of the photosensitive drums 1*a* to 1*d* are electrostatically charged uniformly. Then, through irradiation by an exposing device 5 with light based on the image data, electrostatic latent images based on the image data are formed on the photosensitive drums 1*a* to 1*d* respectively. The developing devices 3*a* to 3*d* are charged with predetermined amounts of two-component developer (hereinafter, also referred to simply as developer) containing toner of different colors, namely cyan, magenta, yellow, and black respectively, from toner containers 4*a* to 4*d*. The toner contained in the developer is fed from the developing devices 3*a* to 3*d* to the photosensitive drums 1*a* to 1*d*, and electrostatically attaches to them. Thereby, toner images are formed based on the electrostatic latent images formed by exposure to light from the exposing device 5.

Then, an electric field is applied, by primary transfer rollers 6*a* to 6*d*, between the primary transfer rollers 6*a* to 6*d* and the photosensitive drums 1*a* to 1*d* with a predetermined transfer voltage. Thereby, the cyan, magenta, yellow, and black toner images on the photosensitive drums 1*a* to 1*d* are primarily transferred to the intermediate transfer belt 8. Toner and the like that remain on the surfaces of the photosensitive drums 1*a* to 1*d* after primary transfer are removed by cleaning devices 7*a* to 7*d*.

Transfer sheets P to which toner images are to be transferred are stored in a sheet cassette 16 arranged in a lower part inside the color printer 100. A transfer sheet P is conveyed, via a sheet feeding roller 12*a* and a registration roller pair 12*b*, with predetermined timing, to a nip (secondary transfer nip) between a secondary transfer roller 9, which is arranged next to the intermediate transfer belt 8, and the intermediate transfer belt 8. The transfer sheet P having the toner images secondarily transferred to it is conveyed to a fixing portion 13.

The transfer sheet P conveyed to the fixing portion 13 is then heated and pressed there by a fixing roller pair 13*a* so that the toner images are fixed to the surface of the transfer sheet P to form a predetermined full-color image. The transfer sheet P having the full-color image formed on it is discharged as it is (or after being distributed by a branching portion 14 into a reverse conveyance passage 18 and having images formed on both sides of it) onto a discharge tray 17 via a discharge roller pair 15.

Figure 2:
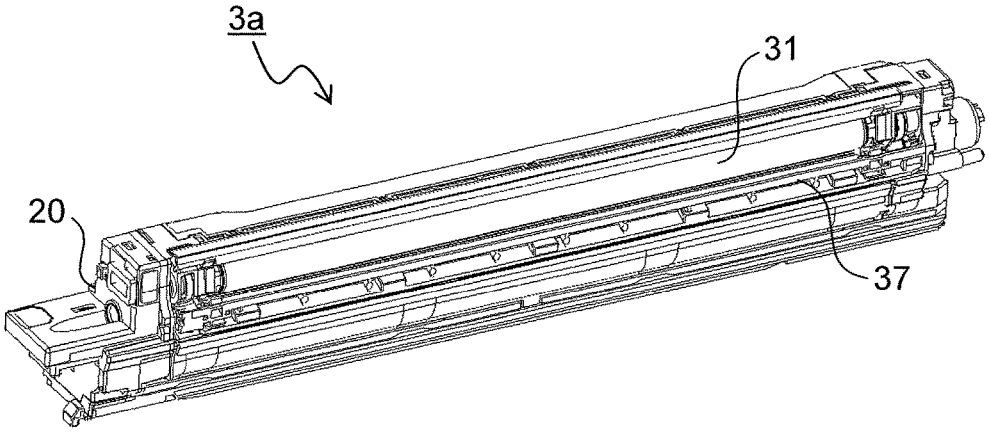
FIG. 2 is a perspective view of the developing device according to a first embodiment of the present disclosure.
Figure 3:
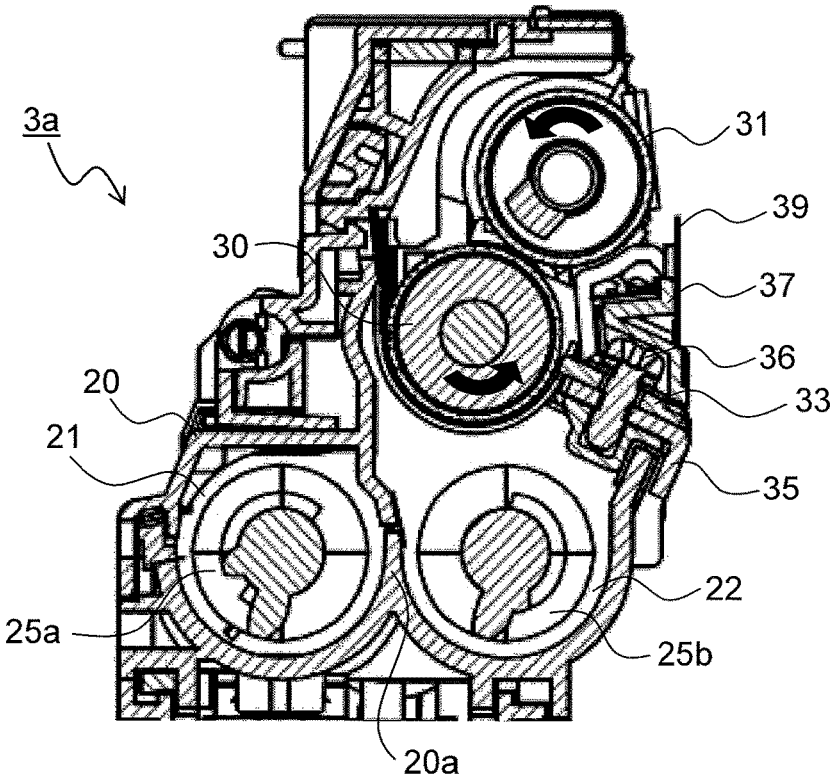
FIG. 3 is a side sectional view of the developing device according to the first embodiment.

FIG. 2 is an exterior perspective view of the developing device 3*a* according to a first embodiment of the present disclosure. FIG. 3 is a schematic side sectional view of the developing device 3*a* according to the first embodiment. FIG. 3 shows the developing device 3*a* as seen from the rear side in FIG. 1, and accordingly, the arrangement of components in the developing device 3*a* in FIG. 3 is reversed left to right as compared with that in FIG. 1. Although the following description deals with, as an example, the developing device 3*a* arranged in the image forming portion Pa in FIG. 1, the developing devices 3*b* to 3*d* arranged in the image forming portions Pb to Pd have basically the same structure, and thus no overlapping description will be repeated. In the following description, the near side of the color printer 100 main body is referred to as the front side, and the far side of the color printer 100 main body is referred to as the rear side. For example, in FIG. 2, the left end of the developing device 3*a* is at the front side, and the right end of the developing device 3*a* is at the rear side.

As shown in FIGS. 2 and 3, the developing device 3*a* has a developer container (casing) 20 in which two-component developer is stored. The developer container 20 is divided into a stir-conveyance chamber 21 and a feed-conveyance chamber 22 by a partition wall 20*a*. In the stir-conveyance chamber 21 and the feed-conveyance chamber 22, there are rotatably arranged a stirring-conveying screw 25*a* and a feeding-conveying screw 25*b* respectively, for mixing and stirring toner (positively charged toner) fed from the toner container 4*a* (see FIG. 1) with carrier and for electrostatically charging the toner.

Then, by the stirring-conveying screw 25*a* and the feeding-conveying screw 25*b*, developer is conveyed, while being stirred, in the axial direction (the direction perpendicular to the plane of FIG. 3), to circulate between the stir-conveyance chamber 21 and the feed-conveyance chamber 22 via an unillustrated developer passage formed at opposite end parts of the partition wall 20*a*. That is, the stir-conveyance chamber 21, the feed-conveyance chamber 22, and the developer passage constitute a circulation passage of developer in the developer container 20.

The developer container 20 extends obliquely to the upper right side in FIG. 3; in the developer container 20, a toner feeding roller 30 is arranged over the feeding-conveying screw 25*b*, and a developing roller 31 is arranged opposite the toner feeding roller 30, obliquely on the upper right of it. Moreover, the developing roller 31 is arranged opposite the photosensitive drum 1*a* (see FIG. 1) beside an opening (on the right side in FIG. 3) in the developer container 20. The toner feeding roller 30 and the developing roller 31 rotate about their respective rotation shafts in the counter-clockwise direction in FIG. 3.

In the stir-conveyance chamber 21, an unillustrated toner concentration sensor is arranged to face the stirring-conveying screw 25*a*. Based on the result of detection by the toner concentration sensor, toner is supplied from the toner container 4*a* via an unillustrated toner supply port into the stir-conveyance chamber 21. As the toner concentration sensor, for example, a magnetic permeability sensor is used that detects the magnetic permeability of two-component developer containing toner and magnetic carrier in the developer container 20.

The toner feeding roller 30 is a magnetic roller composed of a non-magnetic rotary sleeve, which rotates in the counter-clockwise direction in FIG. 3, and a fixed magnet member, which is housed in the rotary sleeve and which has a plurality of magnetic poles.

The developing roller 31 is composed of a cylindrical developing sleeve, which rotates in the counter-clockwise direction in FIG. 3, and a developing roller-side magnetic pole, which is fixed in the developing sleeve. A predetermined gap is secured between the toner feeding roller 30 and the developing roller 31 at their facing position (opposing position) at which they face each other. The developing roller-side magnetic pole has the opposite polarity to that of a magnetic pole (main pole) of the fixed magnet member, the developing roller-side magnetic pole facing the magnetic pole.

To the developer container 20, a trimming blade (regulating blade) 33 is fitted along the longitudinal direction of the toner feeding roller 30 (the direction perpendicular to the plane of FIG. 3). The trimming blade 33 is, with a blade fixing screw 36, fastened and fixed to a blade supporting stay 35 fitted to the developer container 20. The trimming blade 33 is positioned, in the rotation direction of the toner feeding roller 30 (the counter-clockwise direction in FIG. 3), on the upstream side of the opposing position of the developing roller 31 and the toner feeding roller 30. Moreover, a small gap is formed between a tip end part of the trimming blade 33 and the surface of the toner feeding roller 30.

To the developing roller 31, a direct-current voltage (hereinafter, referred to as Vslv(DC)) and an alternating-current voltage (hereinafter, referred to as Vslv(AC)) are applied. To the toner feeding roller 30, a direct-current voltage (hereinafter, referred to as Vmag(DC)) and an alternating-current voltage (hereinafter, referred to as Vmag (AC)) are applied. These direct-current voltages and alternating-current voltages are applied from a developing bias power supply via a bias control circuit (none of these is illustrated) to the developing roller 31 and the toner feeding roller 30.

As described above, by the stirring-conveying screw 25*a* and the feeding-conveying screw 25*b*, developer circulates, while being stirred, through the stir-conveyance chamber 21 and the feed-conveyance chamber 22 in the developer container 20, and thereby the toner contained in the developer is electrostatically charged. The developer in the feed-conveyance chamber 22 is conveyed to the toner feeding roller 30 by the feeding-conveying screw 25*b*. Then, a magnetic brush (unillustrated) is formed on the toner feeding roller 30. The magnetic brush on the toner feeding roller 30 has its layer thickness regulated by the trimming blade 33, and is then conveyed, by the rotation of the toner feeding roller 30, to a region where the toner feeding roller 30 and the developing roller 31 face each other. Then, by this magnetic field and by the potential difference ΔV between the Vmag(DC) applied to the toner feeding roller 30 and the Vslv(DC) applied to the developing roller 31, a thin layer of toner is formed on the developing roller 31.

The thickness of the toner layer on the developing roller 31 varies according to the resistance of developer, the difference in rotation speed between the toner feeding roller 30 and the developing roller 31, and the like, but can be controlled by controlling the potential difference ΔV. Increasing the potential difference ΔV makes the layer of toner on the developing roller 31 thicker, and decreasing the potential difference ΔV makes the layer of toner thinner. A proper range of the potential difference ΔV during development is from 100V to 350V.

The thin layer of toner formed on the developing roller 31 as a result of the developing roller 31 making contact with the magnetic brush on the toner feeding roller 30 is conveyed, by the rotation of the developing roller 31, to a region where the photosensitive drum 1 a and the developing roller 31 face each other. Since Vslv(DC) and Vslv(AC) are applied to the developing roller 31, due to the potential difference between the developing roller 31 and the photosensitive drum 1*a*, toner flies from the developing roller 31 to the photosensitive drum 1*a* so that an electrostatic latent image on it is developed.

Toner left unused during development is conveyed once again to the region where the developing roller 31 and the toner feeding roller 30 face each other, and is collected by the magnetic brush on the toner feeding roller 30. Then, the magnetic brush is removed from the toner feeding roller 30 at a part of the fixed magnet member having the same polarity, and then falls into the feed-conveyance chamber 22.

Then, based on the result of detection by the toner concentration sensor (unillustrated), a predetermined amount of toner is supplied through the toner supply port (unillustrated) into the developer container 20, and the mixture circulates through the feed-conveyance chamber 22 and the stir-conveyance chamber 21 to again become two-component developer which has a proper toner concentration and which is electrostatically charged uniformly. This developer is again, by the feeding-conveying screw 25*b*, fed to the toner feeding roller 30 to form a magnetic brush thereon, and is conveyed to the trimming blade 33.

In the developer container 20, in the right-side wall in FIG. 3, near the developing roller 31, there is provided a sleeve cover 37 which protrudes inward of the developer container 20 and which has a substantially V-shaped section. As shown in FIG. 3, the sleeve cover 37 is arranged along the longitudinal direction of the developer container 20 (the direction perpendicular to the plane of FIG. 3). A top surface 37*a* (see FIG. 4) of the sleeve cover 37 constitutes, inside the developer container 20, an inner wall part that faces the developing roller 31.

At the top end of the sleeve cover 37, a film-form sealing member 39 is provided. The sealing member 39 extends in the longitudinal direction of the sleeve cover 37 (the direction perpendicular to the plane of FIG. 3) such that a tip end part of the sealing member 39 is in contact with the surface of the photosensitive drum 1*a* (see FIG. 1), and serves as a shield to prevent the toner inside the developer container 20 from leaking out.

Figure 4:
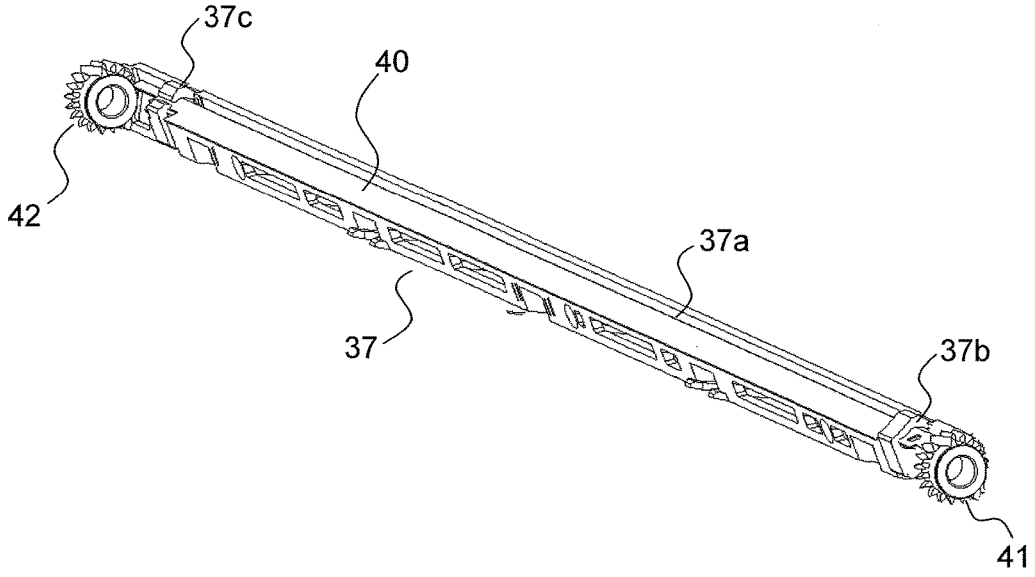
FIG. 4 is a perspective view of a sleeve cover used in the developing device according to the first embodiment as seen from the inside of a developer container.
Figure 5:
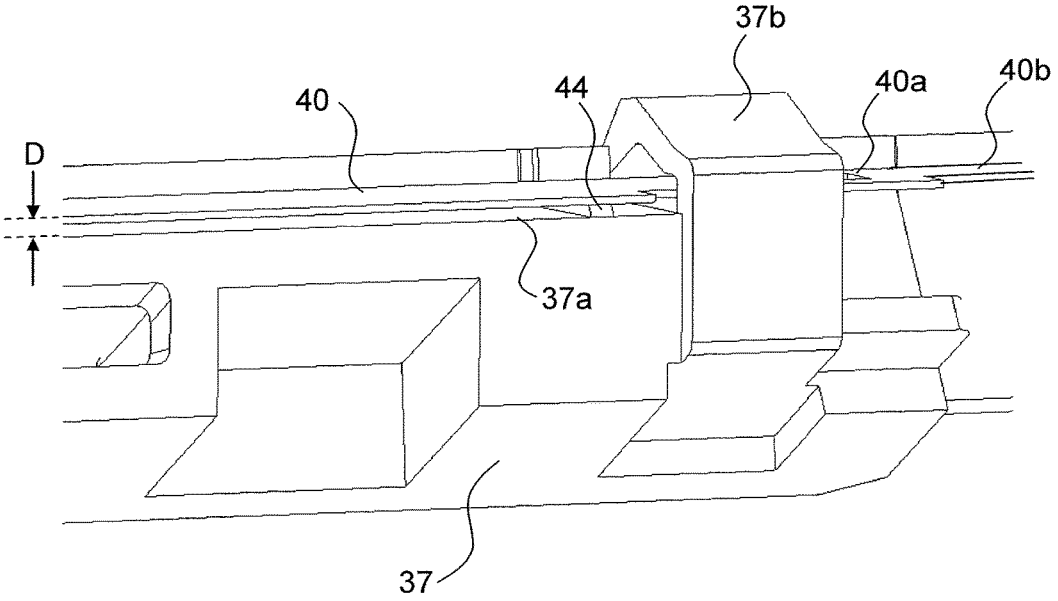
FIG. 5 is an enlarged perspective view of a part of the sleeve cover in FIG. 4 where a top surface of the sleeve cover and a film member face each other.
Figure 6:
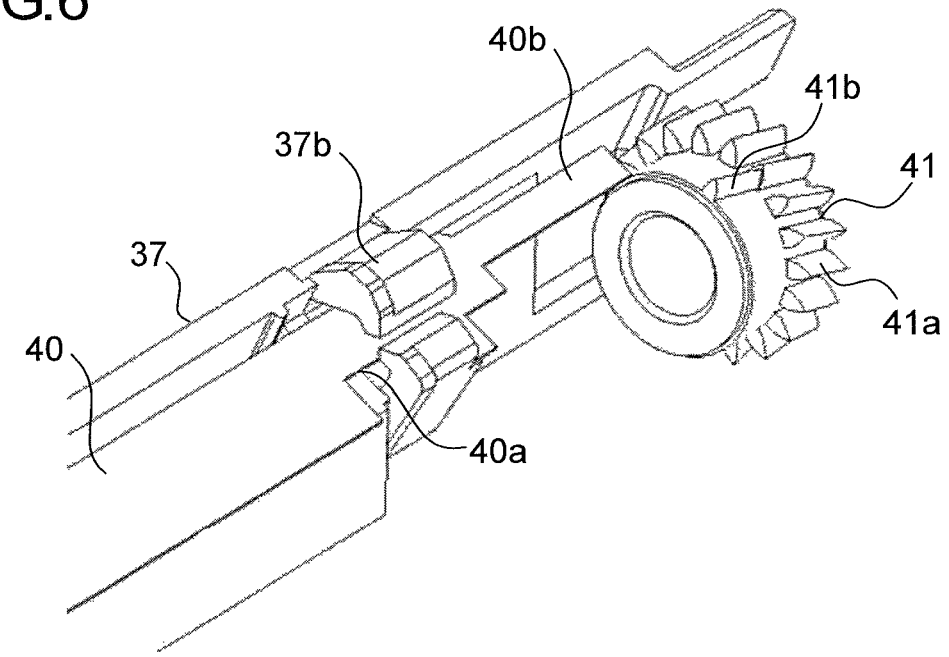
FIG. 6 is an enlarged perspective view around a front-side end part of the sleeve cover in FIG. 4.
Figure 7:
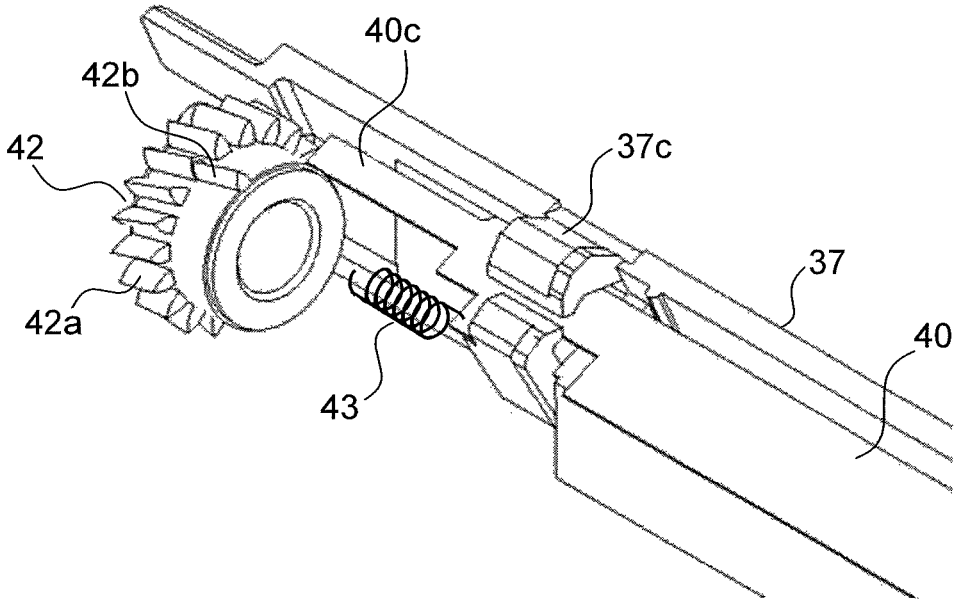
FIG. 7 is an enlarged perspective view around a rear-side end part of the sleeve cover in FIG. 4.

FIG. 4 is a perspective view of the sleeve cover 37 as seen from the inside (left side in FIG. 3) of the developer container 20. FIG. 5 is an enlarged perspective view of a part of the sleeve cover 37 in FIG. 4 where the top surface 37*a* and a film member 40 face each other. FIGS. 6 and 7 are enlarged perspective views around the front-side end part (right end part in FIG. 4) and around the rear-side end part (left end part in FIG. 4), respectively, of the sleeve cover 37 in FIG. 4.

As shown in FIG. 4, on the top surface 37*a* of the sleeve cover 37, the film member 40 is supported along the longitudinal direction. The film member 40 is formed of a flexible resin material such as a PET (polyethylene terephthalate) film, and is arranged over substantially the entire area of the top surface 37*a* of the sleeve cover 37. It is preferable that, as a material of the film member 40, a fluororesin film or the like be used or that the film member 40 be coated with fluororesin so that toner is less likely to attach to the film member 40 than to the sleeve cover 37. The film member 40 is vibrated under tension as will be described later, and thus needs to have a certain degree of resilience (stiffness).

In front-side (the right side in FIG. 4) and rear-side (the left side in FIG. 4) end parts of the top surface 37*a* of the sleeve cover 37, there are formed guide portions 37*b* and 37*c* into which the end parts of the film member 40 are inserted.

As shown in FIG. 5, the top surface 37*a* of the sleeve cover 37 is provided with a rib 44 near the front-side guide portion 37*b*. Although no illustration is given here, also near the rear-side guide portion 37*c*, a rib 44 is provided at the same height. This permits the film member 40 to be supported with a predetermined distance D from the top surface 37*a* of the sleeve cover 37.

As shown in FIG. 6, on the front side of the sleeve cover 37, a cutout portion 40*a*, which is formed in a side edge of the film member 40, is hooked on the guide portion 37*b*, and thereby the movement of the film member 40 is restricted in the longitudinal direction. On the other hand, as shown in FIG. 7, on the rear side of the sleeve cover 37, one end of a coil spring 43 is fastened to the film member 40, and the other end of the coil spring 43 is fastened to a locking portion (unillustrated) of the sleeve cover 37.

With this structure, the movement of one end (the front-side end part) of the film member 40 is restricted by the engagement of the cutout portion 40*a* with the guide portion 37*b*, and the other end (the rear-side end part) of the film member 40 is biased toward the rear side by the coil spring 43. Thus, the film member 40 is given a predetermined tension in the longitudinal direction. The front-side end part of the film member 40 may also be provided with a coil spring 43 so that the film member 40 is given the tension at the opposite end parts.

As shown in FIG. 6, in the front-side end part of the film member 40, there is formed a first protruding segment 40*b* which extends through and beyond the guide portion 37*b* toward the front side. The first protruding segment 40*b* is positioned near the circumferential surface of a first idle gear 41 which is coupled to a drive input gear 45*a* (see FIG. 8) of the toner feeding roller 30 and to a drive input gear 45*b* (see FIG. 8) of the developing roller 31. The first idle gear 41 has, on its circumferential surface, a first protrusion 41*b* formed by extending one of cogs 41*a* inward.

As shown in FIG. 7, in the rear-side end part of the film member 40, there is formed a second protruding segment 40*c* which extends through and beyond the guide portion 37*c* toward the rear side. The second protruding segment 40*c* is positioned near the circumferential surface of a second idle gear 42 which is coupled to a drive transmission gear 50*d* (see FIG. 9) which is rotatably supported about the rotation shaft of the toner feeding roller 30. The second idle gear 42 has, on its circumferential surface, a second protrusion 42*b* formed by extending one of cogs 42*a* inward.

The first idle gear 41 and the second idle gear 42 are arranged with their phases shifted from each other such that the positions of the first protrusion 41*b* and the second protrusion 42*b* formed respectively on the circumferential surfaces of the first idle gear 41 and the second idle gear 42 are 180° shifted from each other in the circumferential direction.

Figure 8:
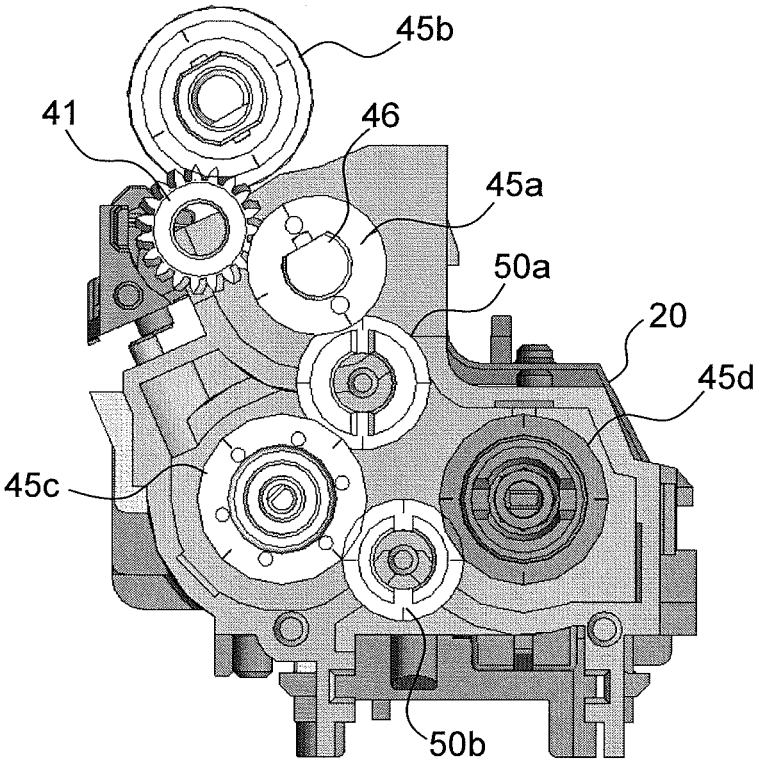
FIG. 8 is a side sectional view of a driving mechanism of the developing device according to the first embodiment as seen from the inside on the front side of the developing device.
Figure 9:
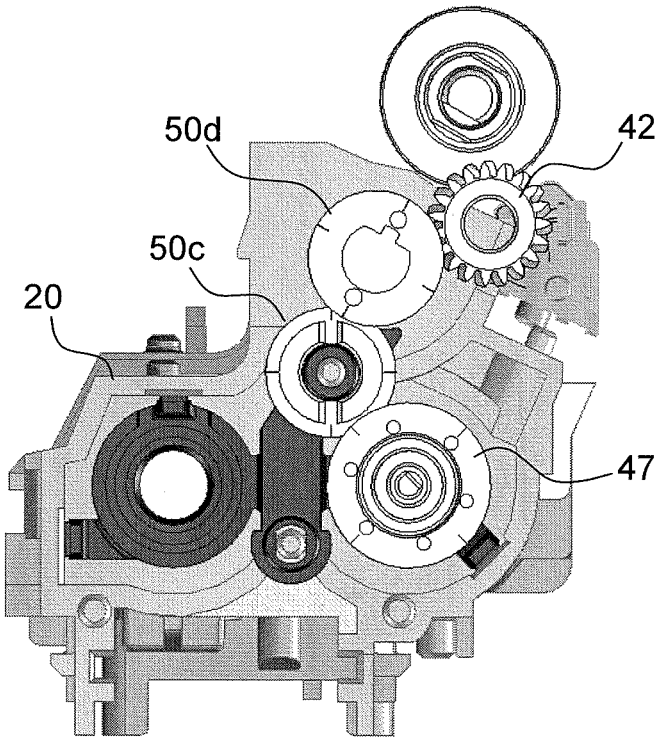
FIG. 9 is a side sectional view of the driving mechanism of the developing device according to the first embodiment as seen from the inside on the rear side of the developing device.
Figure 10:
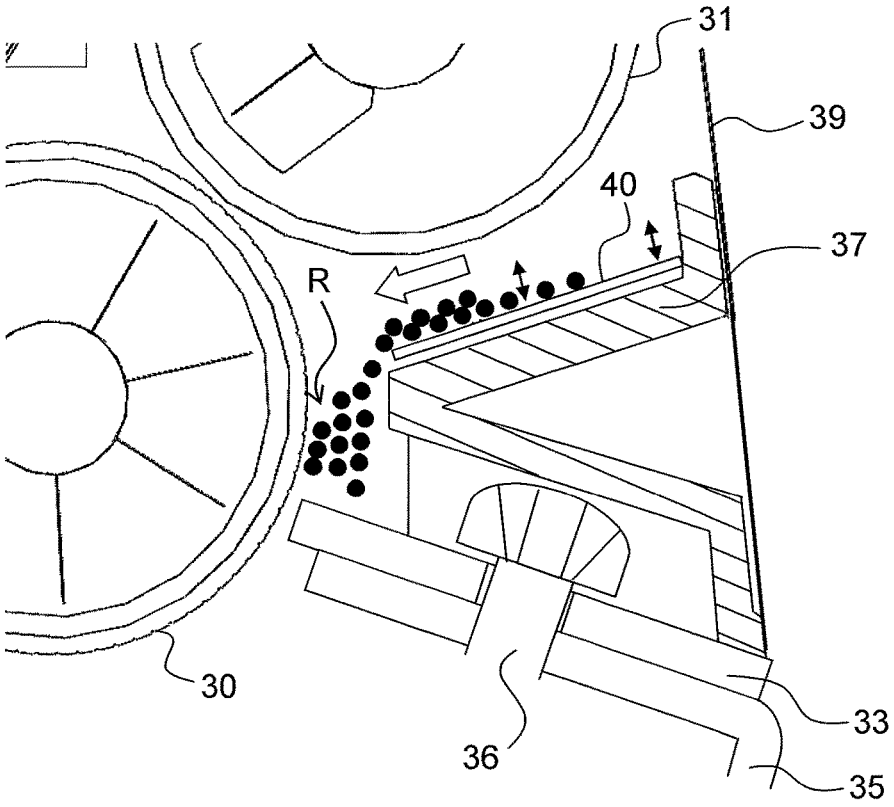
FIG. 10 is a side sectional view around the sleeve cover in the developing device according to the first embodiment.

FIGS. 8 and 9 are side sectional views of a driving mechanism of the developing device 3*a* as seen from the inside on the front side and on the rear side, respectively, of the developing device 3*a*. FIG. 10 is a partial sectional view around the sleeve cover 37 in the developing device 3*a*.

As shown in FIG. 8, on the front side of the developing device 3*a*, in the drive input gear 45*a* provided at one end of the toner feeding roller 30, there is formed a fitting hole 46 in which a color printer main body-side drive output coupling (unillustrated) is fitted; this permits a driving force to be fed via the drive input gear 45*a* to the developing device 3*a*. The drive input gear 45*a* is coupled with the first idle gear 41. The first idle gear 41 is coupled with the drive input gear 45*b* provided at one end of the developing roller 31.

The drive input gear 45*a* is coupled, via a drive transmission gear 50*a*, with a drive input gear 45*c* provided at one end of the stirring-conveying screw 25*a*. The drive input gear 45*c* is coupled, via a drive transmission gear 50*b*, with a drive input gear 45*d* provided at one end of the feeding-conveying screw 25*b*.

On the other hand, on the rear side of the developing device 3*a*, a drive output gear 47 provided at the other end of the stirring-conveying screw 25*a* is coupled, via a drive transmission gear 50*c*, to the drive transmission gear 50*d* rotatably provided at the other end of the toner feeding roller 30. The drive transmission gear 50*d* is coupled with the second idle gear 42.

In image formation, as the toner feeding roller 30 and the developing roller 31 are driven to rotate, the first idle gear 41, which meshes with the drive input gear 45*a* of the toner feeding roller 30, rotates. Then, via the drive transmission gear 50*a*, the drive input gear 45*c*, which is provided at one end of the stirring-conveying screw 25*a*, also rotates, and the drive output gear 47, which is provided at the other end of the stirring-conveying screw 25*a*, also rotates. Then, the second idle gear 42, which is coupled via the drive transmission gears 50*c* and 50*d* to the drive output gear 47, also rotates.

Here, on the front side of the film member 40, the first protrusion 41*b* provided on the circumferential surface of the first idle gear 41 makes contact with an edge of the first protruding segment 40*b* of the film member 40 every time the first idle gear 41 rotates one turn. On the other hand, on the rear side of the film member 40, the second protrusion 42*b* provided on the circumferential surface of the second idle gear 42 makes contact with an edge of the second protruding segment 40*c* of the film member 40 every time the second idle gear 42 rotates one turn.

As a result, the film member 40 under the tension vibrates like a string of a string instrument. By the vibration of the film member 40, as shown in FIG. 10, toner accumulated on the film member 40 is shaken off. Thus, even when the toner feeding roller 30 and the developing roller 31 in the developing device 3*a* rotate at high speed, and the amount of suspended toner in the developer container 20 is large, it is possible to suppress accumulation of toner on the top surface 37*a* of the sleeve cover 37. The toner shaken off from the film member 40 falls into a region R between the sleeve cover 37 and the toner feeding roller 30.

With the above-described structure, it is possible, without depending on the linear velocity of the feeding roller 30 and the developing roller 31, to effectively suppress image defects such as toner droppings resulting from the toner accumulated on the top surface 37*a* of the sleeve cover 37 agglomerating (into blocks) and attaching to the toner feeding roller 30 and the developing roller 31.

The accumulation of toner is prevented by vibrating the film member 40, and thus there is no need to separately provide a toner removing member such as a brush member which removes the toner on the sleeve cover 37; this achieves a compact and space-saving structure. There is no danger of foreign matter ascribable to the toner removing member circulating through the developer container 20 together with developer, and thus it is possible to effectively prevent image defects such as dropouts resulting from the foreign matter being held in a gap between the trimming blade 33 and the toner feeding roller 30.

In image formation, the film member 40 is vibrated by use of the rotation of the first idle gear 41 and the second idle gear 42 which inevitably rotate, and thus there is no need to separately provide a motor, an actuator, or the like dedicated to vibrating the film member 40; this makes the internal structure of the developing device 3*a* simple.

The first and second protruding segments 40*b* and 40*c* in opposite end parts of the film member 40 are vibrated by the first idle gear 41 and the second idle gear 42, and thus the entire area of the film member 40 in its longitudinal direction can be greatly vibrated. As a result, it is possible to evenly shake off the toner accumulated over the entire area of the film member 40. Owing to the positions of the first protrusion 41*b* and the second protrusion 42*b* formed on the circumferential surfaces of the first idle gear 41 and the second idle gear 42 being 180° shifted from each other in the circumferential direction, the opposite end parts of the film member 40 are alternately vibrated; this increases the amplitude of the vibration of the film member 40 over its entire area in the longitudinal direction.

Here, to bring the toner having fallen in the region R back into the feed-conveyance chamber 22, when no image is being formed, the toner feeding roller 30 is preferably rotated in the direction (the clockwise direction in FIG. 10) opposite to the rotation direction of the toner feeding roller 30 in image formation. The toner having fallen into the region R and been temporarily accumulated near a tip end part of the trimming blade 33 is, by rotating the toner feeding roller 30 in the opposite direction, collected by the magnetic brush formed on the surface of the toner feeding roller 30. The toner collected by the magnetic brush rotates together with the toner feeding roller 30 and passes through the gap between the toner feeding roller 30 and the trimming blade 33. Then, the toner is removed from the toner feeding roller 30 at a part of the fixed magnet member having the same polarity, and is forcibly brought back into the feed-conveyance chamber 22 (see FIG. 3).

Figure 11:
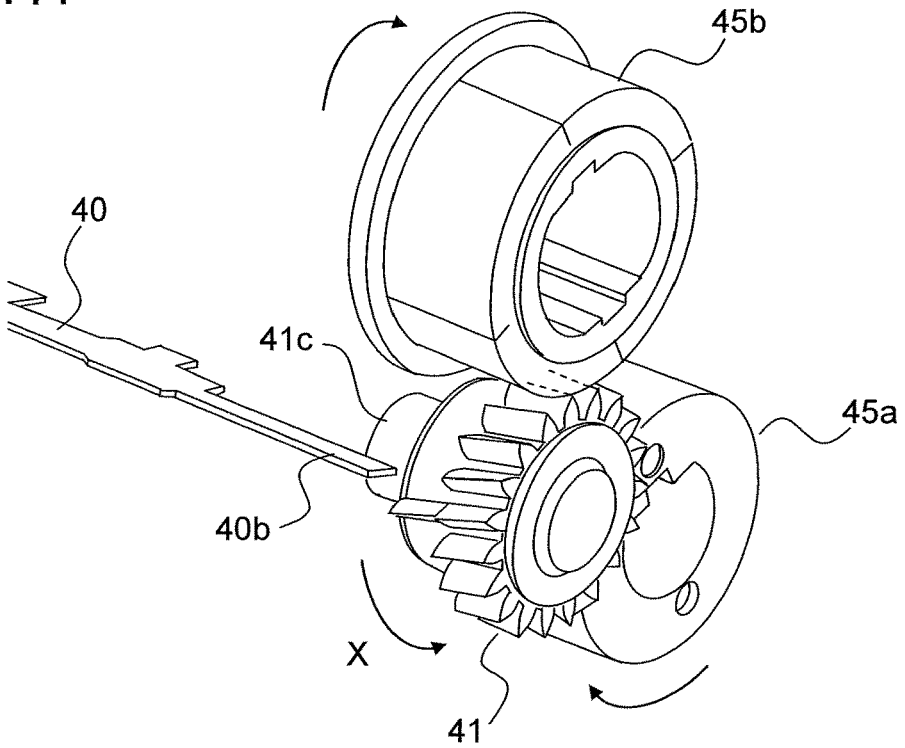
FIG. 11 is a schematic perspective view showing a positional relationship, in a developing device according to a second embodiment of the present disclosure, among a first idle gear, drive input gears, and a first protruding segment of a film member when a toner feeding roller is rotated in the forward direction.
Figure 12:
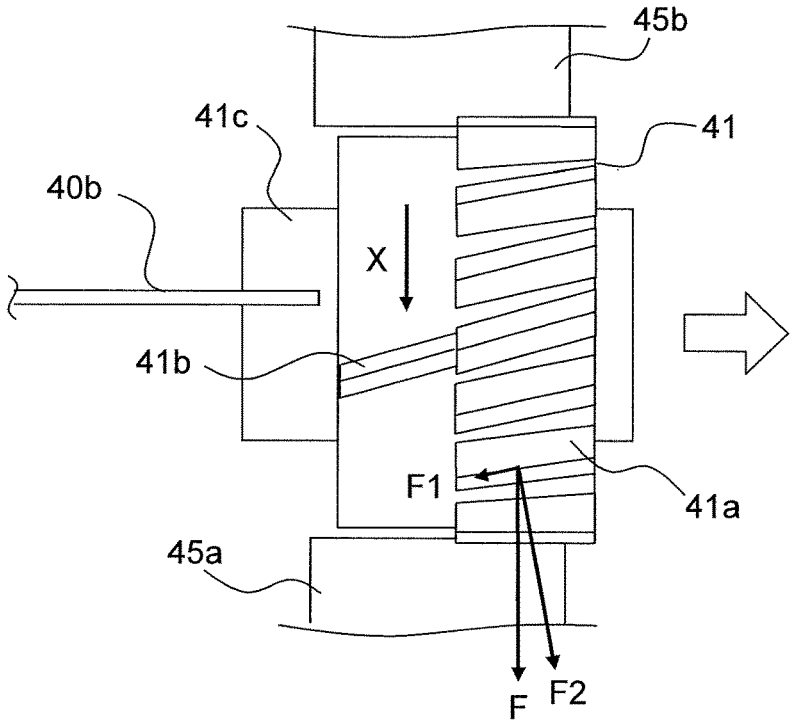
FIG. 12 is a partly enlarged view showing how the first idle gear and the drive input gears in FIG. 11 mesh with each other.

FIG. 11 is a schematic perspective view showing a positional relationship, in a developing device 3*a* according to a second embodiment of the present disclosure, among the first idle gear 41, the drive input gears 45*a* and 45*b*, and the first protruding segment 40*b* of the film member 40 when the toner feeding roller 30 is rotated in the forward direction. FIG. 12 is a partly enlarged view showing how the first idle gear 41 and the drive input gears 45*a* and 45*b* in FIG. 11 mesh with each other.

In this embodiment, the first idle gear 41 is a helical gear, and the drive input gears 45*a* and 45*b* which mesh with the first idle gear 41 are also helical gears. In FIGS. 11 and 12, the cogs of the drive input gears 45*a* and 45*b* are omitted from illustration. Although no illustration is given here, the second idle gear 42 is also a helical gear, and so is the drive transmission gear 50*d* which meshes with the second idle gear 42. Except that the second idle gear 42-side structure is symmetric left-to-right with the first idle gear 41-side structure, the second idle gear 42-side structure is similar to the first idle gear 41-side structure; thus, no overlapping description will be repeated.

The first idle gear 41 meshes with the drive input gear 45*a* which feeds a rotation driving force to the toner feeding roller 30 and with the drive input gear 45*b* which feeds a rotation driving force to the developing roller 31. The drive input gear 45*a* is coupled with a driving motor (unillustrated), and the driving force of the drive input gear 45*a* is transmitted via the first idle gear 41 to the drive input gear 45*b*. The first idle gear 41 is fitted around a rotation shaft 41*c* so as to be movable in the thrust direction (the left-right direction in FIG. 12).

During image formation, as the toner feeding roller 30 and the developing roller 31 are rotated in the forward direction (the counter-clockwise direction in FIG. 3), the first idle gear 41 which meshes with the drive input gears 45*a* and 45*b* rotates in the direction indicated by arrow X in FIGS. 11 and 12. Here, as shown in FIG. 12, to the cog 41*a* of the first idle gear 41, a pressing force F by which it is pushed down in the downward direction is applied by the drive input gear 45*a*. The pressing force F is divided into a component force Fl parallel to the extending direction of the cog 41*a* and a component force F2 perpendicular to the extending direction of the cog 41*a*.

Here, the component force F2 acts on the first idle gear 41 so as to press it in the rightward direction, and thus the first idle gear 41 moves along the rotation shaft 41*c* in the rightward direction. As a result, the first protrusion 41*b* provided on the circumferential surface of the first idle gear 41 is located at a position (first position) away from the first protruding segment 40*b* of the film member 40. Thus, the film member 40 does not vibrate, but remains at rest even when the first idle gear 41 is rotated.

Figure 13:
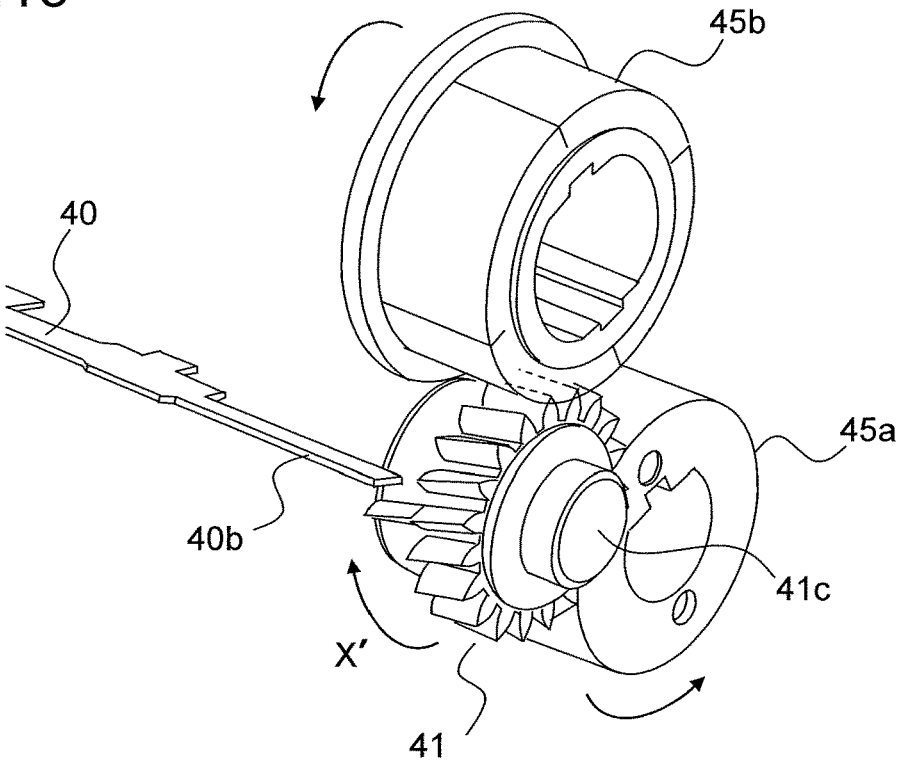
FIG. 13 is a schematic perspective view showing a positional relationship, in the developing device according to the second embodiment, among the first idle gear, the drive input gears, and the first protruding segment of the film member when the toner feeding roller is rotated in the reverse direction.
Figure 14:
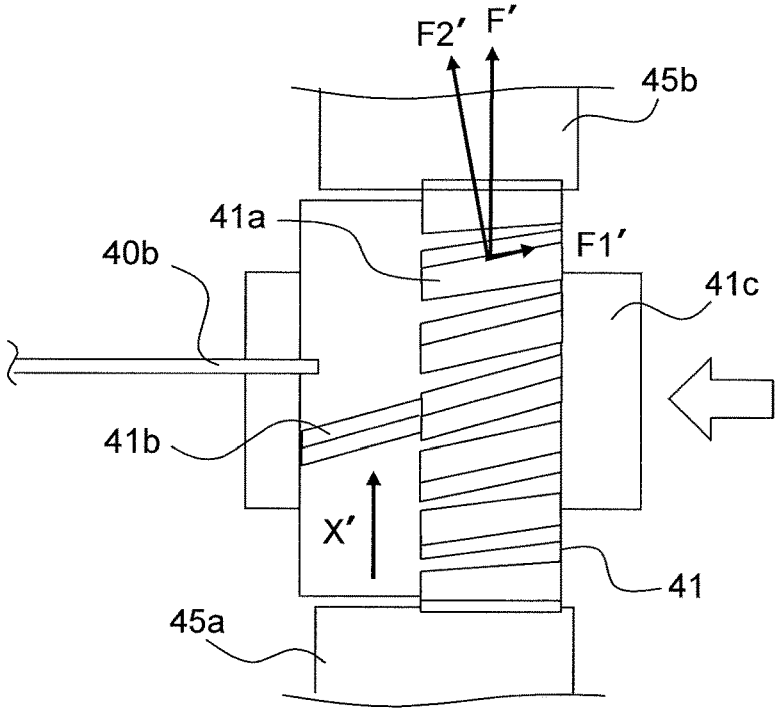
FIG. 14 is a partly enlarged view showing how the first idle gear and the drive input gears in FIG. 13 mesh with each other.

FIG. 13 is a schematic perspective view showing a positional relationship among the first idle gear 41, the drive input gears 45*a* and 45*b*, and the first protruding segment 40*b* of the film member 40 when the toner feeding roller 30 is rotated in the reverse direction. FIG. 14 is a partly enlarged view showing how the first idle gear 41 and the drive input gears 45*a* and 45*b* in FIG. 13 mesh with each other. As in FIGS. 11 and 12, in FIGS. 13 and 14, the cogs of the drive input gears 45*a* and 45*b* are omitted from illustration.

When no image is being formed, as the toner feeding roller 30 and the developing roller 31 are rotated in the opposite direction (the clockwise direction in FIG. 3), the first idle gear 41 which transmits a driving force to the drive input gear 45*b* of the developing roller 31 rotates in the direction indicated by arrow X' in FIGS. 13 and 14. Here, as shown in FIG. 14, to the cog 41*a* of the first idle gear 41, a pressing force F' by which it is pushed up in the upward direction is applied by the drive input gear 45*a*. The pressing force F' is divided into a component force F1' parallel to the extending direction of the cog 41*a* and a component force F2' perpendicular to the extending direction of the cog 41*a*.

Here, the component force F2' acts on the first idle gear 41 so as to press it in the leftward direction, and thus the first idle gear 41 moves along the rotation shaft 41*c* in the leftward direction. As a result, the first protrusion 41*b* provided on the circumferential surface of the first idle gear 41 is located at a position (second position) overlapping an edge of the first protruding segment 40*b* of the film member 40. Thus, every time the first idle gear 41 rotates one turn, the first protrusion 41*b* makes contact with the edge of the first protruding segment 40*b* of the film member 40, and the film member 40 under tension vibrates like a string of a string instrument.

The moving range of the first idle gear 41 in the axial direction of the rotation shaft 41*c* is preferably adjusted such that the overlap between the first protrusion 41*b* and the edge of the first protruding segment 40*b* is about 2 mm when the first idle gear 41 has moved farthest in the leftward direction (the direction approaching the first protruding segment 40*b*). The amount of the movement of the first idle gear 41 in the axial direction of the rotation shaft 41*c* can be adjusted by adjusting the inclination of the cogs 41*a* and the rotation amount (rotation angle) of the first idle gear 41 in the opposite direction.

With the structure according to this embodiment, during image formation, during which the toner feeding roller 30 and the developing roller 31 are rotated in the forward direction, the film member 40 does not vibrate; thus there is no danger of the toner accumulated on the film member 40 being shaken off and falling onto the toner feeding roller 30 during image formation. Thus, it is possible to prevent occurrence of image defects due to toner droppings. When no image is being formed, the toner feeding roller 30 and the developing roller 31 are rotated in the opposite direction; thereby the accumulated toner can be shaken off by vibrating the film member 40 and be collected by the magnetic brush on the toner feeding roller 30 rotating in the opposite direction to be efficiently brought back into the feed-conveyance chamber 22.

The embodiments described above are in no way meant to limit the present disclosure, which thus allows for many modifications and variations within the spirit of the present disclosure. For example, the shapes and the structures of the sleeve cover 37 and the film member 40 described in the above-described embodiments are merely examples, and are not meant as any limitation; thus they can be set as necessary according to the structure and the like of the developing device 3*a*.

For example, although, in the above-described embodiments, the first protruding segment 40*b* and the second protruding segment 40*c* of the film member 40 are vibrated by use of the first protrusion 41*b* and the second protrusion 42*b* provided on the first idle gear 41 and the second idle gear 42, the first protruding segment 40*b* and the second protruding segment 40*c* of the film member 40 may be vibrated by use of another gear that constitutes a gear train that drives the toner feeding roller 30 or the developing roller 31.

Although, in the above-described embodiments, the first protrusion 41*b* and the second protrusion 42*b* provided on the first idle gear 41 and the second idle gear 42 are arranged with their positions 180° shifted from each other in the circumferential direction, the angle by which the positions (phases) of the first protrusion 41*b* and the second protrusion 42*b* are shifted from each other is not limited to 180°, but may instead be another angle. The first idle gear 41 and the second idle gear 42 may be provided with a plurality of first protrusions 41*b* and a plurality of second protrusions 42*b* respectively.

Although the above-described embodiments deal with the tandem-type color printer 100 as an example, needless to say, the present disclosure is applicable, for example, to monochrome and color copiers, digital multifunction peripherals, monochrome printers, facsimile machines, and the like. Next, by way of practical examples, the effects of the present disclosure will be described more specifically.

Figure 15:
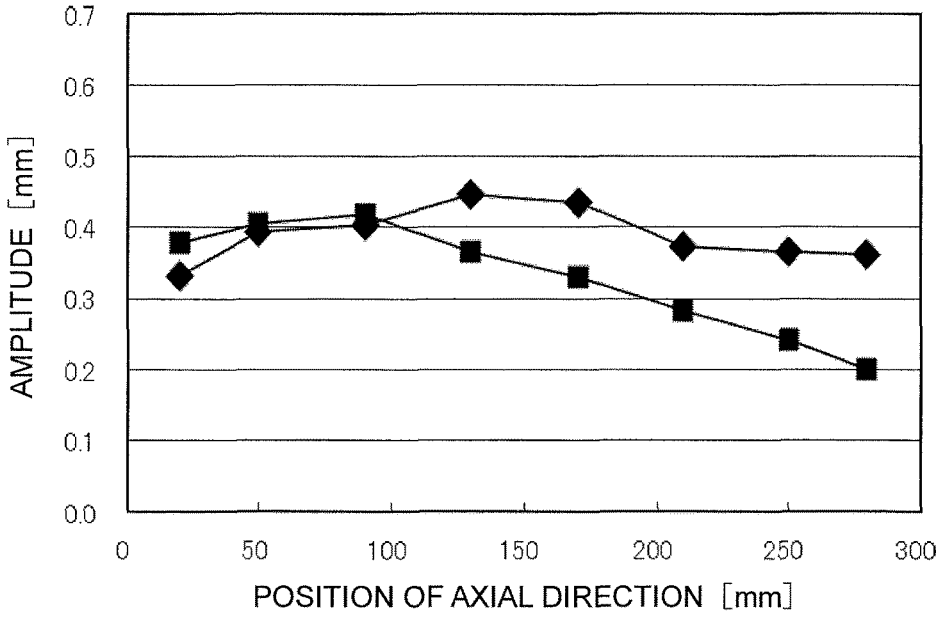
FIG. 15 is a diagram comparing the distribution of the amplitude of the film member in its longitudinal direction between in a case (present disclosure) where opposite end parts of the film member are alternately vibrated and in another case (Comparative Example) where only one end part of the film member is vibrated.

PRACTICAL EXAMPLES:

The distribution of the amplitude of the film member 40 in its longitudinal direction was studied. In the test, with each of a developing device 3*a* (present disclosure) where opposite end parts (the first protruding segment 40*b* and the second protruding segment 40*c*) of the film member 40 were alternately vibrated by the first idle gear 41 and the second idle gear 42 and a developing device 3*a* (Comparative Example) where only one end part (the first protruding segment 40*b*) of the film member 40 was vibrated by the first idle gear 41, the waveform (amplitude) of vibration was measured as the position of the film member 40 was varied in its longitudinal direction. As the film member 40, a strip of PET film having a length of 300 mm, a width of 5.5 mm, and a thickness of 0.25 mm was used. FIG. 15 shows the results. In FIG. 15, the vertical axis represents the amplitude of the film member 40, and the horizontal axis represents the position of the film member 40 in its longitudinal direction (axial direction), from 0 mm at the front side to 300 mm at the rear side.

As shown in FIG. 15, with the developing device 3*a* according to the present disclosure where the opposite end parts of the film member 40 were alternately vibrated (the data series indicated by solid rhombic symbols in FIG. 15), the distribution of the amplitude of the film member 40 in its longitudinal direction fell within a range of 0.3 mm to 0.45 mm, and the film member 40 vibrated evenly over its entire area in the longitudinal direction.

By contrast, with the developing device 3*a* of Comparative Example where only one end part of the film member 40 was vibrated (the data series indicated by solid square symbols in FIG. 15), while the amplitude of the film member 40 at one end part (front side) in the longitudinal direction was about 0.4 mm, the amplitude of the film member 40 at the other end part (rear side) in the longitudinal direction was about 0.2 mm. The amplitude of the film member 40 at the rear side was smaller than that with the present disclosure. The above results confirm the following. With the developing device 3*a* according to the present disclosure, as compared with Comparative Example, the film member 40 vibrates evenly over its entire area in the longitudinal direction, and provides an effect of satisfactorily shaking off the toner accumulated on the film member 40 over its entire area in the longitudinal direction.

The present disclosure is applicable to a developing device that has an inner wall part facing a developing roller between a blade in a casing and an image carrying member.

Based on the present disclosure, it is possible to effectively suppress accumulation of toner in the inner wall part of the developing device. By incorporating such a developing device, it is possible to provide an image forming apparatus that can effectively prevent image defects such as toner droppings due to accumulation of toner.

What is claimed is:

1. A developing device comprising:

a developing roller arranged opposite an image carrying member on which an electrostatic latent image is formed, the developing roller feeding toner to the image carrying member in a region where the developing roller and the image carrying member face each other;

a toner feeding roller arranged opposite the developing roller, the toner feeding roller feeding toner to the developing roller in a region where the toner feeding roller and the developing roller face each other;

a regulating blade arranged opposite the toner feeding roller across a predetermined gap;

a casing which houses therein the developing roller, the toner feeding roller, and the regulating blade, the casing having an inner wall part that faces the developing roller between the regulating blade and the image carrying member;

a film member which is flexible, the film member being arranged with a predetermined distance from a top surface of the inner wall part, the film member being able to vibrate in a direction approaching or away from the inner wall part;

a biasing member coupled to at least one end of the film member in a longitudinal direction thereof, the biasing member applying a tension to the film member;

a first gear coupled to a gear train that drives the developing roller or the toner feeding roller, the first gear having formed on a circumferential surface thereof at least one first protrusion which vibrates the film member by intermittently making contact with one edge of the film member; and a second gear coupled to a gear train that drives the developing roller or the toner feeding roller, the second gear having formed on a circumferential surface thereof at least one second protrusion which vibrates the film member by intermittently making contact with another edge of the film member.

2. The developing device of claim 1, wherein the first gear and the second gear are arranged with phases thereof shifted such that positions of the first protrusion and the second protrusion are shifted from each other in a circumferential direction.

3. The developing device of claim 2, wherein the first gear and the second gear are arranged with phases thereof shifted such that the positions of the first protrusion and the second protrusion are 180° shifted from each other in the circumferential direction.

4. The developing device of claim 1, wherein the first protrusion and the second protrusion intermittently make contact with one edge and another edge of the film member respectively only when the first gear and the second gear are rotated in a direction opposite to a direction in which the first gear and the second gear are rotated during image formation.

5. The developing device of claim 4, wherein the first gear and the second gear are helical gears which are coupled to a gear train that drives the toner feeding roller, and are reciprocatable in a rotation axis direction according to a rotation direction of a gear that meshes with the first gear and the second gear, between a first position where the first protrusion and the second protrusion are away from an edge of the film member and a second position where the first protrusion and the second protrusion overlap the edge of the film member, and during image formation, rotating the toner feeding roller causes the first gear and the second gear to be located at the first position, and when no image is being formed, rotating the toner feeding roller in a direction opposite to a direction in which the toner feeding roller is rotated during image formation causes the first gear and the second gear to be located at the second position.

6. The developing device of claim 1, wherein the film member is formed of a material having weaker toner adhesion than the inner wall part.

7. The developing device of claim 1, wherein the toner feeding roller is a magnetic roller that carries thereon two component developer containing toner and carrier by action of a plurality of magnetic poles provided inside the magnetic roller.

8. An image forming apparatus comprising the developing device of claim 1.

* * * * *